United States Patent [19]

Singh

[11] 3,990,391

[45] Nov. 9, 1976

[54] MOUNTING FOR PRESSURE FIXING ROLLERS

[75] Inventor: Jagmohan Singh, University Heights, Ohio

[73] Assignee: Addressograph Multigraph Corporation, Cleveland, Ohio

[22] Filed: Mar. 19, 1975

[21] Appl. No.: 560,506

[52] U.S. Cl. ..... 118/116; 29/123

[51] Int. Cl.[2] ..... B05C 11/02

[58] Field of Search ..... 118/116, 60, 70, 101, 118/637, 114; 29/113 R, 113 AD, 117, 123, 130, 132; 100/158 R, 176

[56] References Cited

UNITED STATES PATENTS

| | | | |
|---|---|---|---|
| 2,762,295 | 9/1956 | Varga et al. | 19/65 CR X |
| 3,064,452 | 11/1962 | Gast, Jr. | 29/123 X |
| 3,097,590 | 7/1963 | Justus | 29/129 |
| 3,581,659 | 6/1971 | Bryer | 29/123 X |
| 3,649,985 | 3/1972 | Hunt | 29/117 X |
| 3,846,151 | 11/1974 | Roteman et al. | 118/116 X |
| 3,854,975 | 12/1974 | Brenneman et al. | 118/114 X |

*Primary Examiner*—Dorsey Newton
*Attorney, Agent, or Firm*—Sol L. Goldstein

[57] ABSTRACT

A device for pressure fixing powder images utilizing a pair of rollers in pressure contact and in skewed relationship, each of the rollers formed with a solid shaft or core encased in a tubular metal casing and including an elastomeric collar that fits into a recess formed by circumferentially cutting out portions at the ends of the shaft and the casing and supports the shaft at its ends inside the casing providing an annular air space between the shaft and the inside casing wall. The shaft ends are received in conventional bearings and under high compressive loads the shaft deflection is much greater than the deflection in the casing because of this elastomeric collar permitting much smaller skewing angles, particularly for rolls that exceed 10 inches in length.

7 Claims, 5 Drawing Figures

MOUNTING FOR PRESSURE FIXING ROLLERS

BACKGROUND OF THE INVENTION

This invention relates to improvements in devices for pressure fixing electroscopic toner powders at ambient temperatures and more particularly to the technique of mounting such rollers under conditions that would minimize the flexural stresses and deflection introduced into such rollers under heavy load conditions.

Electrostatic copying methods and apparatus for accomplishing reproduction of graphic subject matter are well known in the art. One of the important steps in such a reproduction process is the fixing of the powder image on the surface which is ultimately to become the copy. The electroscopic powders or toners, as they are known, are generally thermoplastic in nature and heat responsive. It is conventional in this art to use heat to fuse such thermoplastic materials to the copy sheet. The combination of heat and pressure has also been used to fix the powder to the copy sheet.

The use of pressure, without any heat whatsoever, has been suggested whereby the toners may be fixed to the copy sheet. Such a method and apparatus are fully described in U.S. Pat. No. 3,854,975 issued to Richard S. Brenneman, David W. Lovering and Frederick E. Barr granted on Dec. 17, 1974 and assigned to the same assignee of the present application. The term fixing, as it is used in this art, refers to the technique of permanently affixing a powder image to a substrate so that it will adhere and retain its imagewise configuration without disruption as a result of normal handling which is experienced by a copy sheet in normal business usage.

A significant and major advancement in this technology has been made where the advent of the pressure fixing apparatus and method disclosed in the Brenneman, et al., patent, in overcoming the disadvantages of using heat systems to cause the powder image to adhere to the base support or copy sheet. The use of such an invention in which the electroscopic powder is fixed by pressure alone, that is, without heat, is not without disadvantages. The conditions of applying high compressive forces on such a device impose stringent requirements on its design, and in particular the alignment of rollers with respect to one another.

One solution to such a problem is to slightly skew the rollers, which is a technique well known in the art and conventional in overcoming the problem of nonuniform pressure across the operating length of such rollers. While intentional skewing of the rollers solves the problem of nonuniform pressure, it introduces other problems such as wrinkling sheets of paper that pass through the system. The problem of wrinkling sheets of paper which pass between skewed rollers becomes aggravated when the sheets of paper are used in a high humidity environment.

The primary problem in using rollers to which is applied a very high compressive force at the bearing mounts is the bowing of deflection that occurs in the shaft thereby imparting a camber to the roller. The effect is to have the rollers under such high compressive forces move away from one another at the center by a distance that is directly related to the increased compressive force applied at the ends of the roller. This produces high pressure at the edges but lower pressure at the center. This uneven pressure results in an uneven fixing of the developed image.

Skewing the roller will tend to minimize the problem, but it is desirable to have a minimum amount of angular skew of the roller so as to minimize the wrinkling problem. It will be appreciated that as the length of the rollers are extended in order to accommodate wider sheets of paper, the pressure is decreased at the nip of the rollers for a given compressive force. In order to effectively fix the powder image, it then becomes necessary to increase the force for longer rollers. This results in greater deflection. In order to combat greater deflection, wider diameter rollers can be used. It will readily be appreciated that such a piece of equipment becomes cumbersome, unwieldly and costly to manufacture.

The present invention is directed to reducing the amount of skewing or offsetting of the rollers and thereby minimizing the problem of wrinkling but also to substantially decrease the amount of deflection for a given load while keeping the size and the construction of the equipment within reasonable limits. The invention is directed to a roller construction in which the ends of the shaft or core of the roller are fitted with an elastomeric collar on which is supported a tubular casing so as to form an annular space between the shaft and the casing.

SUMMARY OF THE INVENTION

It is a general object of the present invention to provide a new and improved device for fixing electroscopic powder images on wide copy sheets under conditions where a high compressive force is applied at the bearing mount to produce a different and lower deflection in the outer casing of the roller in relation to the deflection that occurs in the shaft.

It is another object of the present invention to provide a new and improved device for the pressure fixing of images of original documents on wide copy material which substantially minimizes the risk of wrinkling as said copy material passes between such roller construction by decreasing the amount of deflection experienced by the outer surface of such a roller as compared to the shaft portion.

It is a specific object of this invention to provide a new and improved device for the pressure fixing of images of wide original document on copy material of a like size through the use of skewed rollers in pressure arrangement with one another through a simplified construction that provides reliable operation in which the working surface of the rollers is separated from the mounting shaft through an intervening elastomeric coupling whereby lesser deflection results in the outer casing as compared to the inner shaft.

The above and other objects of the present invention are achieved by a device for fixing images of original documents and copy material by providing two rollers each having solid cores or shafts which are then concentrically mounted inside a tubular casing with the shaft being supported by a pair of elastomeric collars that fit over the ends of the shaft and fittingly contained on the inside diameter of the tubular casing. The shaft ends of each of the rollers are then mounted in a conventional bearing for rotation movement with respect to one another. The rollers are disposed at a slightly skewed angle in order to maintain uniform pressure across the contact area between the two rollers.

One of the two rollers in a preferred embodiment has a substantially more resilient or compliant surface than the other roller and this also will tend to permit the more resilient roller to somewhat overlap the less resilient roller thereby permitting an even application of very high pressure developed across the surface of a copy sheet passing between the rollers to evenly fix a developed image of an original document thereon.

As further described in U.S. Pat. No. 3,854,975, the electroscopic powders or toners can be fixed by employing as a working surface on the deformable roll a material which has a modulus of elasticity in compression permitting, when said rollers are loaded sufficiently to provide a calculated peak pressure at the nip of the rollers in excess of the threshold pressure for the toner powder. As an example, under a compressive modulus within the range of about 100,000 pounds per square inch (psi) and about 6,000,000 psi so that when loaded, develops a calculated peak nip pressure averaging between 5,000 and 10,000 pounds per square inch. The resilient layer undergoes deformation by an amount which exceeds the combined thickness variations of the copy sheet and the toner powder thereon. The Brenneman invention discloses the use of a cotton filled roll having a Durometer hardness of about 80 and a calculated modulus of elasticity in compression of about 200,000 psi. Other suitable materials for forming the outer surface of the compliant roll include hard rubber, cellulose or paper materials formed into a suitable layer, or the layer may be formed from corn cobs or asbestos. Generally, a very large range of resilient synthetic resinous materials such as nylon and acetal resins may be used to advantage.

The thickness variations that can be accommodated by the compliant roll disclosed in the aforementioned Brenneman patent are small and of the type encountered during normal operation of the pressure fixing device. The deformation which the outer resilient working surface of the one roll experiences is in the order to magnitude of 0.0004 inches, which is well within the elastic limit of the materials employed for such outer working layer of the roll.

BRIEF DESCRIPTION OF THE DRAWINGS

The above and other objects, advantages, and novel features of the present invention will become apparent from a reading of the following detailed description of the preferred embodiments of the invention illustrated in the accompanying drawings therein.

DETAILED DESCRIPTION

Figure 1:
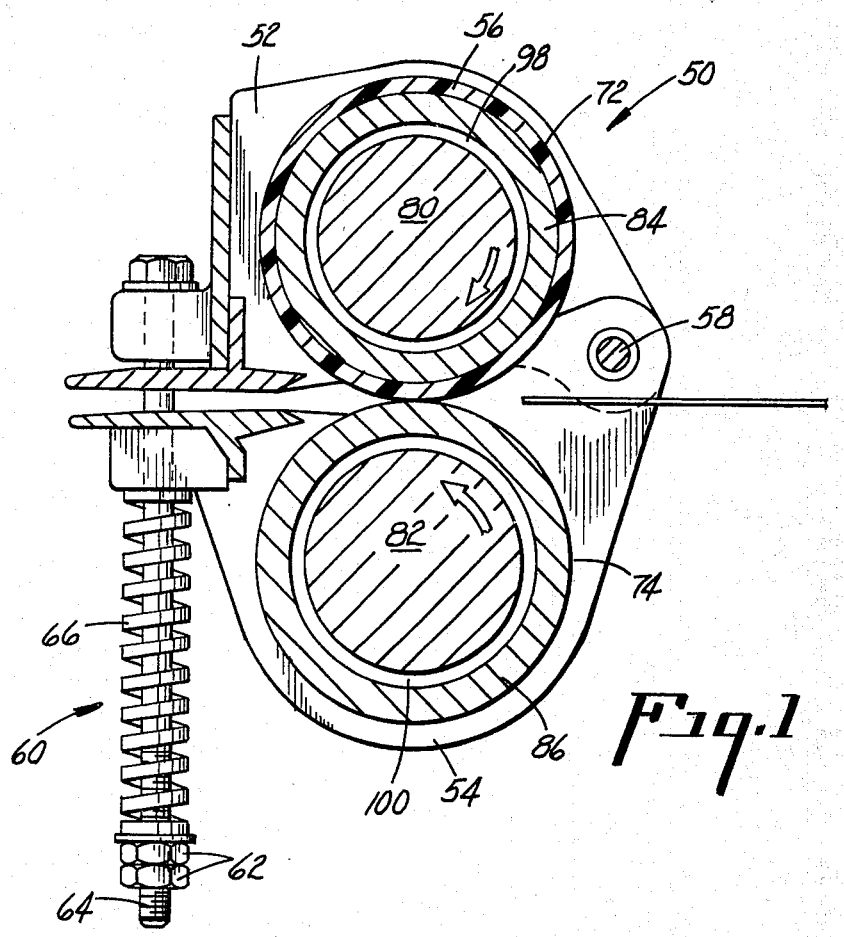
FIG. 1 is a cross-sectional view of a fixing device embodying the features of the present invention.
Figure 2:
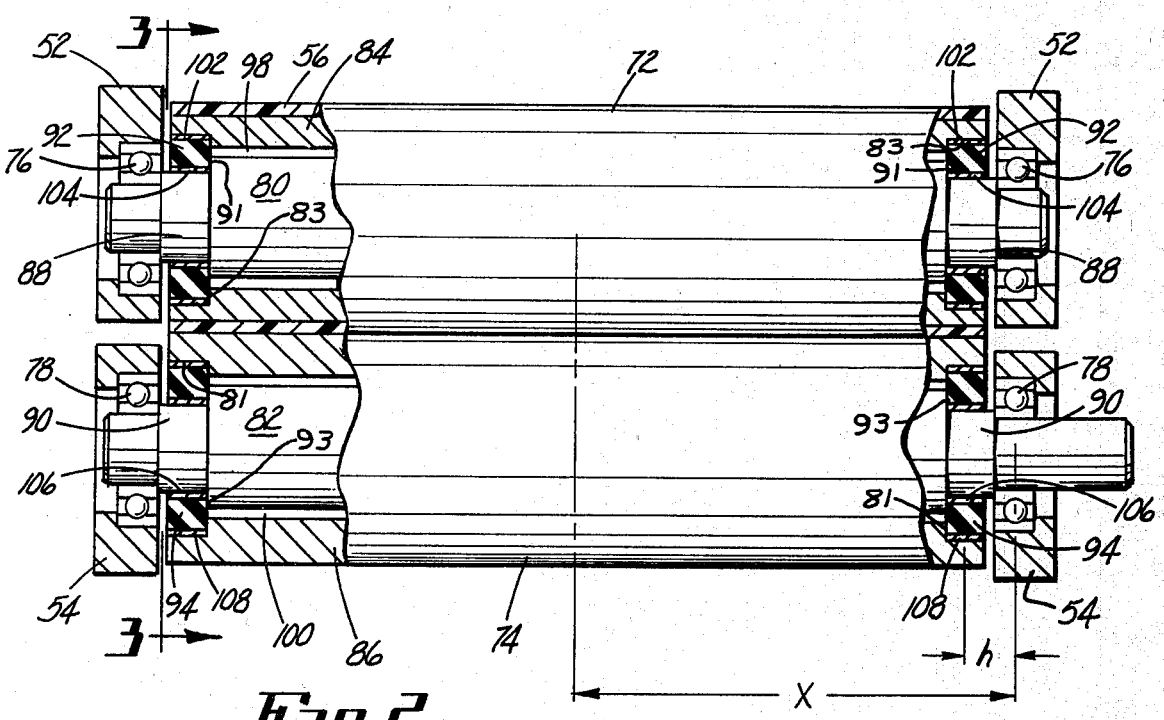
FIG. 2 is a front elevational view in partial section illustrating the invention.

Referring to FIGS. 1 and 2 of the drawings, there is disclosed a new and improved fixing device identified with the general reference numeral 50 which is constructed and operates in accordance with the principles of the present invention. The fixing device 50 is used to fix a developed image of an original on a copy paper and includes two rollers 72 and 74 in pressure engagement with one another. The rollers 72 and 74 are rotatably mounted with their shaft ends captured in the bearings 76 and 78 which are respectively contained in the side frames 52 and 54 (FIG. 1). The axes of rotation of the rollers 72 and 74 are slightly skewed with respect to one another.

In practice the rolls are first positioned with their axes of rotation in parallel alignment and then by turning one of the rolls about a vertical center line so the shaft at each end is offset a distance of less than 0.1 inch for a roll of about 9–10 inches long until the proper skewing angle is achieved.

The surface of one of the rollers 72 and 74 is preferably more resilient or compliant than the surface of the other roller as is known from the aforementioned Brenneman patent. For example, the upper roller 72 contains on its outer surface a sheath 56 of nylon such as disclosed in U.S. application Ser. No. 301,463 filed in the name of Peder Pedersen and assigned to the same assignee as the invention of this application. Both the upper roller 72 and the lower roller 74 include, respectively, central, longitudinal shafts 80 and 82 having their shaft ends received in the bearing 76 and 78 which in turn are disposed in the side frames 52 and 54. The side frames 52 and 54 are hingedly mounted about a shaft 58 in spaced apart relationship by suitable cross ties (not shown). The rollers 72 and 74 may be held in pressure engagement by a pair of nut, bolt and spring assemblies 60, one being located at each end of the shaft ends. The assemblies 60 each include a nut 62, a threaded bolt 64 and a spring 66. It will be appreciated that by either tightening or loosening the nuts 62 on the threaded bolts 64 one can compress the spring 66 to increase the pressure engagement of the rollers 72 and 74 and conversely by loosening the nuts, the pressure between the rollers 72 and 74 may be reduced.

The advantages of the invention described hereinabove may be realized by a special mounting of the lateral ends of the shaft in an elastomeric collar so that the shaft is maintained in spaced apart relationship from the co-extensive outer tubular casing.

At the end of each of the shafts 80 and 82, there is provided smaller diameter stub portions 88 and 90 than the main diameter of the shafts 80 and 82 so as to form cut-outs or recesses 91 and 93. The inside diameter of the casings 84 and 86, at the ends thereof, are enlarged forming recesses 81 and 83. The combination of the recesses 91 and 81 and 93 and 83 form receptacles into which are received the collars 92 and 94. The collars 92 and 94 are pressed fit over the stub shaft portions 88 and 90, respectively, and each collar has an outer diameter to tightly fit inside the ends of the tubular casings 84 and 86.

As shown in FIG. 2, the mounting arrangements of the shaft members 80 and 82 inside the tubular casings are accomplished through the collars 92 and 94 so as to support each of the shafts in spaced apart relationship from their respective tubular casings leaving the annular spaces 98 and 100 in each of the roller arrangements.

The collars 92 and 94 are formed of suitable elastomeric materials such as natural or synthetic rubbers or synthetic resins. As examples of synthetic rubbers, such materials as butadiene-styrene, poly-isoprene, nitrile rubber, neoprene, and butyl polysulfide and silicone rubber. A wide range of synthetic resins such as urethanes, polyacrylates, polybutadiene, fluorosilicones, ethylene propylene, chloro sulfonates, polyethylene, fluorocarbons, propylene oxide and styrene. The elastomeric properties may be measured by Durometer values and the appropriate range for Durometer A should be 50 – 90 units and Durometer D in the range of 55 – 70 units.

Further extensions of the stub shafts 88 and 90 are received in the bearings 76 which in turn are supported in the side frames 52 and 54 of the pressure device shown in FIG. 1.

Any conventional technique may be used for mounting the sets of elastomeric collars on the shafts and tubular member in order to avoid any rotational displacement of these members with respect to one another. In other words, it is desirable to minimize any slippage of the tubular member on the collar relative to the shaft when engaged in a pressure fixing operation. One possible approach is to sandwich the elastomeric collar between thin metal annular rings 102 and 104 and 106 and 108 so that such a collar assembly may be pressed fit onto the shaft and inside the tubular casing.

The advantages and surprising results obtained from the arrangement described in FIG. 2 is two-fold. Firstly, when the roller assembly is placed under a high compressive load at the shaft ends, any deflection of the shafts 80 and 82 is absorbed within the elastomeric collar and due to the annular spaces 98 and 100, there is sufficient room to accommodate the bowing of the shafts at their central portion without the equivalent deformation to the tubular casing. Secondly, the amount of deflection or bowing imparted to the casing is determined by calculating the moment of forces taken at the point where the casing is supported. Hence, the amount of deflection of the casing is directly related to the value of the moment arm. As shown in FIG. 2 in all known prior art mountings of rollers in a conventional bearing arrangement the moment arm for the shaft is taken from the center of the roll to the point where the bearing engages the shaft. The amount of deflection that occurs in the casing of the roller mounting arrangement of FIG. 2 will be much less by virtue of the fact that its moment arm is decreased by an amount which represents the distance that the tubular casing is fixed to the shaft. This moment arm is $X-h$. The elastomeric collar, which actually forms a bushing between the tubular casing and the shaft, decreases the end moment on the flexural deflection of the roll casing.

Figure 3A:
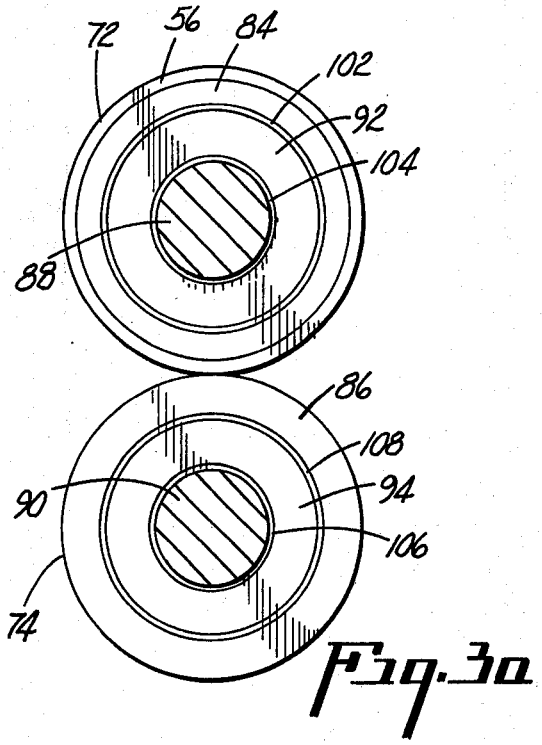
FIG. 3*a* is a cross-section taken along 3—3 illustrating the device under a no load condition.
Figure 3B:
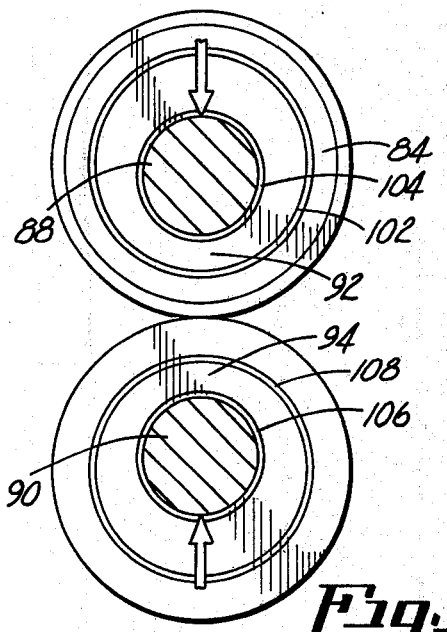
FIG. 3*b* is a cross-section taken along line 3—3 illustrating the device under a compressive load condition.

Referring to FIGS. 3*a* and 3*b*, there is shown the effect of no load and a high compressive load applied to the rollers 72 and 74 at their shaft ends. In FIG. 3*a*, shafts 80 and 82, under a no-load condition, are concentrically positioned with little or no displacement inside the elastomeric collar 92 and 94. In FIG. 3*b* the shafts 80 and 82 under a load applied at the lateral ends of the shafts 80 and 82 in the direction shown by the arrows move in the direction of one another without significantly disturbing the relative position of the tubular casings 84 and 86 with respect to the area where the two rollers meet in nipping contact. As shown in FIG. 3*b*, under a load condition the shafts 80 and 82 are urged towards one another at their lateral ends under the compressive load with the forces being absorbed in the elastomeric collars 92 and 94 with much less displacement occurring in the tubular casings at the lateral edges. A significant amount of the force is absorbed in the elastomeric material and again, the bending moment for the casing has been significantly decreased.

Figure 4:
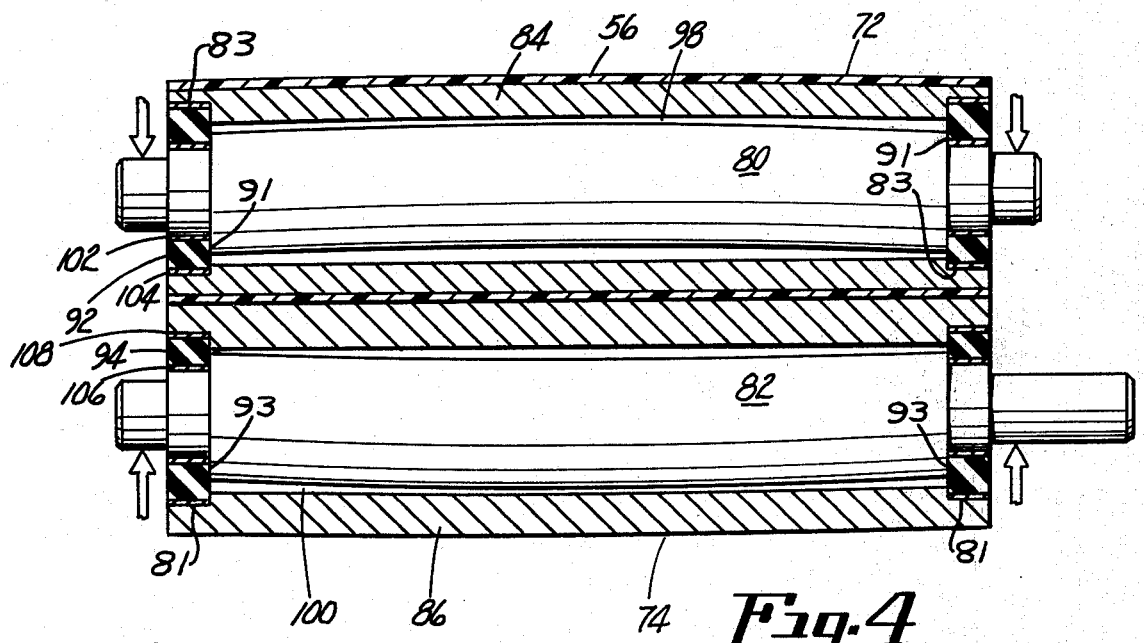
FIG. 4 is a longitudinal cross-section illustrating the device under a compressive load.

Referring now to FIG. 4, there is shown in cross section the condition of the rollers 72 and 74 under the same load conditions as described in connection with FIG. 3*b*. Under the compressive forces applied at the shaft ends in the direction shown by the arrows, there will result a deflection in each of the shafts 80 and 82 so that they bow outwardly from the area where the rollers make nipping contact. At the central portion, the shafts bow outwardly and at the lateral edges, adjacent the location where the force is applied, they are brought into closer contact with one another so that the shafts are brought closer together at their lateral edges and are moved farther away at their central portions using the contact line between the rollers as a reference point. At the central portion, the outward deflection of the shafts 80 and 82 is taken up within the annular spaces 98 and 100, a much lesser deflection or change occurring in the position of the tubular casings 84 and 86 relative to the same reference line. An additional advantage in using the elastomeric collar for mounting the tubular casing and the shaft relative to one another as described hereinabove results in the lesser deflection for a given load as compared to the prior art mountings.

As described earlier, the amount of skewing for a 9 – 10 inch roll is less than 0.1 inches. This invention permits the use of rollers longer than 10 inches, to apply the same pressure without having to apply a greater force or appreciably increasing the diameter of the shafts while keeping the skew distance less than 0.1 inches. It is to be understood that the reference to the skewing distance is merely exemplary. The amount of skewing that can be tolerated by a given system can vary significantly from the example depending on the type materials forming the copy and the speed of operation. Notwithstanding these variations, the advantages of this invention can be realized with any pressure fixing roller arrangement.

What is claimed is:

1. A device for fixing pressure responsive toner powder images capable of responding to pressures above a threshold pressure level to a copy receiving surface comprising a pair of rollers in nipping pressure engagement with one another and capable of developing a peak nip pressure and being rotatably mounted in bearing members and further comprising:

a pair of tubular casings;

a rotatable shaft member disposed in each of said casings in coaxially spaced relation therein, said shaft members having an elastomeric collar axially disposed at its lateral ends, said shaft members and said casings each having recessed formations adjacent the lateral ends thereof forming receiving means for receiving and retaining said elastomeric collar to supportingly maintain said casing in spaced apart relation relative to said shaft, to absorb any deflection in said shaft in the elastomeric member resulting in significantly lower deflection in said tubular casing;

at least one of said tubular casings having an outer sheath of resilient material possessing a modulus of elasticity in compression permitting, when said members are loaded sufficiently to provide a calculated peak nip pressure in excess of the threshold pressure for toner;

whereby said shaft and tubular casings are maintained in spaced apart relationship between their lateral ends when said shafts are placed under a compressive force to generate the peak nip pressure necessary to fix said toner images on the receiving surface.

2. The device as claimed in claim 1 wherein the material of said elastomeric collar has a Durometer A value in the range of 50 – 90 units.

3. The device as claimed in claim 1 wherein the material of said elastomeric collar has a Durometer A value in the range of 55 to 70 units.

4. The device as claimed in claim 1 wherein the elastomeric collar is made of hard rubber.

5. A device for fixing pressure responsive toner powder images capable of responding to pressures above a threshold pressure level to a copy receiving surface comprising a pair of rollers in nipping pressure engagement with one another and capable of developing a peak nip pressure and further comprising:

a pair of tubular casings;

a rotatable shaft member disposed in each of said casings in coaxially spaced relation therein, said shaft members having an elastomeric collar axially disposed at its lateral ends, said shaft members and said casings each having recessed formations adjacent the lateral ends thereof forming receiving means for receiving and retaining said elastomeric collar to supportingly maintain said casing in spaced apart relation relative to said shaft, to absorb any deflection in said shaft in the elastomeric member resulting in significantly lower deflection in said tubular casing;

at least one of said tubular casings having an outer sheath of resilient material possessing a modulus of elasticity in compression permitting when said members are loaded sufficiently to provide a calculated peak nip pressure in excess of the threshold pressure for the toner;

bearing means for rotatably supporting said shaft members;

support means for receiving said bearing members permitting movement of said rollers into adjustable pressure relationship with one another;

whereby said shaft member and tubular casing are maintained in spaced apart relationship between their lateral ends when said shafts are placed under a compressive force to generate the peak nip pressure necessary to fix said toner images on the receiving sheet.

6. The claim as claimed in claim 5 wherein said support means includes biasing means for applying a compressive load to the shafts at each of the bearing mounts.

7. The device as claimed in claim 5 wherein said support means comprises a pair of end plates capable of pivotal movement with respect to one another.

* * * * *